United States Patent [19]

Ramer

[11] 4,141,499

[45] Feb. 27, 1979

[54] CONCRETE RAILROAD BED

[76] Inventor: James L. Ramer, Rte. 1, Box 155, Sullivan, Mo. 63080

[21] Appl. No.: 795,480

[22] Filed: May 10, 1977

[51] Int. Cl.[2] ..... E01B 3/34; E01B 3/38

[52] U.S. Cl. ..... 238/25; 238/87; 238/91; 238/130; 238/265; 238/267

[58] Field of Search ..... 238/24, 25, 42, 46, 238/83–87, 91, 92, 94, 130, 265, 267, 106; 52/223

[56] References Cited

U.S. PATENT DOCUMENTS

| | | | |
|---|---|---|---|
| 903,883 | 11/1908 | Potts | 238/267 |
| 912,219 | 2/1909 | White | 238/25 |
| 1,020,973 | 3/1912 | Frisholm | 238/42 |
| 1,109,267 | 9/1914 | Thomas | 238/91 |
| 1,195,922 | 8/1916 | Fairman | 238/106 |
| 2,300,054 | 10/1942 | Mannaberg | 238/115 |
| 2,496,850 | 2/1950 | Bertrand | 52/223 R X |
| 3,948,010 | 4/1976 | Sonneville | 52/223 R |

FOREIGN PATENT DOCUMENTS

| | | | |
|---|---|---|---|
| 600353 | 4/1931 | Fed. Rep. of Germany | 238/85 |
| 690315 | 9/1930 | France | 238/25 |

*Primary Examiner*—Francis S. Husar
*Assistant Examiner*—Randolph A. Reese
*Attorney, Agent, or Firm*—Thomas O. Maser

[57] ABSTRACT

A cast concrete rail bed is provided which includes plural panels, each panel having a pair of longitudinally extending laterally spaced rail-supporting pedestals, with a connector between them, and each having a rail-receiving slot in its top. Each pedestal has a bottom support surface and inwardly sloping surfaces connected to the top and bottom surfaces. Reinforcement within each pedestal includes a horizontal support below the slot, and a supporting rod extending downwardly from the support and through the bed. A pair of longitudinally extending reinforcing members are supported on the horizontal support, one on each side of the slot, and extending upwardly above the bottom on the slot. A transverse spacer connects the reinforcing members above the horizontal support; tendon ducts are supported by the horizontal support, below the spacer.

2 Claims, 13 Drawing Figures

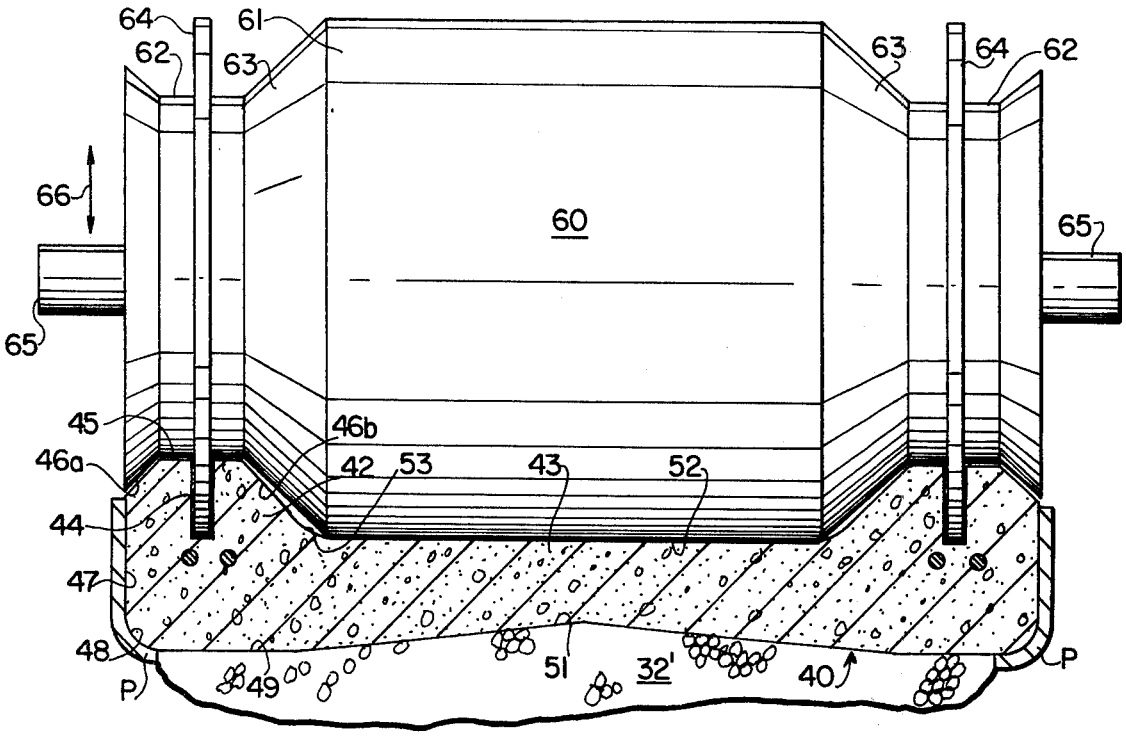
FIG. 3
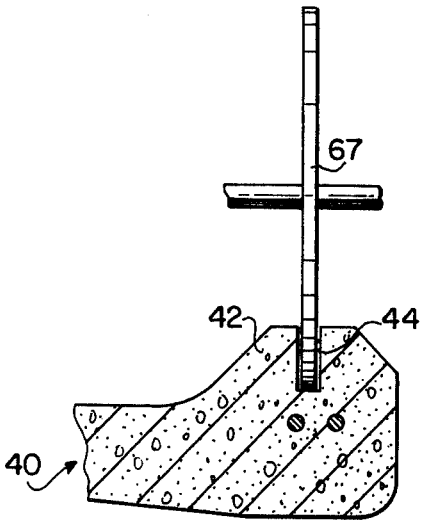
FIG. 4
FIG. 7
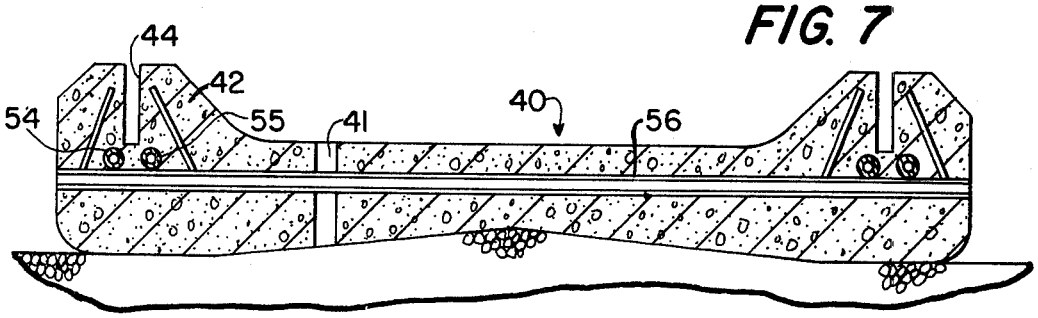

CONCRETE RAILROAD BED

BACKGROUND OF THE INVENTION

The present invention relates to concrete rail beds, to rails for use in connection with the rail beds, and to a method of making rail beds.

There have been provided in the prior art suggestions for the utilization of pre-cast concrete slabs, to be utilized as beds for the rails of a railroad. These have taken various cross-sectional shapes, and in general have been solid slabs. In some instances, generally flat constructions of the slabs have been provided, and in many instances the slabs have had neither adequate sloping shoulders for drainage, nor openings to permit rain to pass through, nor have they had a shape at the bottom thereof for providing satisfactory seating and stability on the ballast underlying the pre-cast slabs.

The provision of reinforcement for concrete has long been known, but such reinforcement has not been disclosed for concrete rail bed constructions in which a pair of pedestals are provided with slots for receiving the stem of a rail to provide the necessary strength to the concrete, in combination with the tensioned characteristics of the concrete rail bed, whether it is cast in place, or pre-cast.

Further, with regard to the providing of particular desired shapes to cast in place concrete rail beds, disclosures of construction methods have been indefinite, so that presumably only conventional shaping methods have been utilized, thereby giving results which, perhaps suitable for the shapes proposed, were not suitable for shapes of rail beds comprising a pair of spaced pedestals each for mounting a rail, and wherein the concrete used has had included in it a minimum amount of water, thereby generating a tearing and separating of the plastic cement paste and the heavier aggregate, the latter occurring when using conventional dray type slip-forms.

There have been provided, over the years, numerous shapes of rails. The most typical comprises an enlarged head, with which the flanged wheels of the railroad cars are engaged, the head being supported by a stem or web extending from beneath it, and the stem or web having at its bottom an outstanding flange. In other suggestions, the flange has been omitted, and there has thereby been provided only the head and the depending stem. Generally speaking, the rails having heads, webs or stems and flanges have been utilized by placing the lower part of the flange on a supporting structure, and then attaching the rail to the supporting structure by a clamp, spike or the like. In certain instances, there has been suggested the embedding of such rails within a concrete slab, so that the flange and stem are substantially embedded in the concrete, while the head is at the surface of the concrete slab. Such constructions have not adequately taken into consideration the various stresses imposed on rails, and the underlying supporting structure.

The stresses applied to a rail, and thus to the supporting structure are of several types. One is the downward force applied to the rail by the wheel which engages it and moves over it. Such loads are dynamic loads, due to the movement along the rail of the wheels. Thus, each part of the rail is subjected to repeated downward loads, and it is known that as the wheel moves along, the rail has an upward force directly behind the wheel.

In addition, on curves there is a lateral or generally horizontal force, caused by engagement of the flange of the wheel with the inner or gage side of the rail head. This tends to move the rail head outwardly, causing an overturning moment on the rail head, as well as causing a shear force on the rail itself, and on the supporting structure of the rail.

It is recognized, also, that the lateral forces on the rail occur even on straight portions of the railroad track, due to the swaying of the railroad cars from side to side. Consequently, lateral forces must be taken into consideration both on curves and on straight sections of the tracks, and it is also noted that this swaying exists even on curves, so that there is the possibility, which must be accounted for, of lateral forces on the inside rail of a curve.

SUMMARY OF THE INVENTION

A pre-cast concrete rail bed is provided made up of a plurality of identical panels, each panel having a pair of laterally spaced longitudinally extending rail supporting pedestals, these pedestals being joined by a plurality of spaced connectors, also made of concrete and integral with the pedestals. The spaces between the connectors thereby provide for lesser weight of concrete, and the use of lesser material. Each of the pedestals is provided with a generally horizontal top surface having a vertically extending slot of generally rectangular cross section, the slot extending from the top surface downwardly into the pedestal and terminating within the pedestal. The pedestals are each provided with a bottom support surface, which is generally horizontal, and there are provided a downwardly and inwardly sloping surface connected to the top surface, and an upwardly inwardly sloping surface connected to the bottom surface. Preferably, the sloping surfaces are joined by an arcuate surface, both to each other and to the noted top and bottom surfaces. The pedestals have outer side walls, joined to the bottom surface by an arcuate surface, to thereby reduce the material required, and also to avoid high stresses at the corners. The connectors have their bottom surfaces in a plane above the bottom surfaces of the pedestals, to thereby provide for good seating on the rail bed on the ballast.

There is disclosed, in addition, the provision of a method of making a cast in place concrete rail bed, wherein slip forms are utilized for providing the shape of the bottom and sides of the cast in place concrete bed, and a shaper, preferably in the form of a cylinder, is moved over the upper surface in order to provide the desired shape, including a pair of elevated pedestals and a connecting panel extending between the elevated pedestals. In addition, the shaper, preferably in the form of a cylinder, may provide for the generation of slots in the pedestals, for receiving the rails. The cylinder is not only rolled over the upper surface of the cast in place plastic concrete mass, but is also vibrated. In addition, the slots in the pedestals may be finished to true dimensions by grinding, as with a grinding wheel.

In another aspect, the present invention provides a cast concrete rail bed, either pre-cast or cast in place, having suitable and unique reinforcements. These include a horizontal support which is somewhat beneath the bottom of the rail-receiving slot formed in each pedestal. Where the concrete rail bed is cast in place, this horizontal support is, in turn, supported by a rod or bar which extends from it, and into the ballast and, thence into the sub-grade. A pair of reinforcing members extend longitudinally in each pedestal, made of rods or bars bent in an undulating, rectangular shape. Each reinforcing member rests on the horizontal support, and each is on a side of the slot which receives the rail. The reinforcing members extend above the bottom of the slot. The horizontal supports serve to support, in addition, ducts for tendons, for compressive stressing of the concrete. A spacer is provided above the ducts, for connecting the reinforcing members to each other.

A rail is provided, having a rail head, a stem extending from the underside of the rail head, and located generally in the median plane of the rail head, the rail having a pair of flanges which extend laterally outwardly on either side of the rail, and the flanges extending from the sides of the rail head, being located remotely from the upper surface of the rail head.

Among the objects of the present invention are the provision of an improved pre-cast concrete rail bed which provides good seating on the ballast, provides light weight, and good drainage. Another object is to provide a cast concrete rail bed having adequate strength, avoiding breaking off of portions thereof under stress.

Other objects of the present invention include the provision of a concrete rail bed which is of adequate strength, being stressed into a compressive state, and having reinforcements which coact with the concrete to provide adequate strength against forces imposed on the rail bed, particularly by the trains moving thereover.

Further objects of the present invention include methods for constructing a concrete rail bed in place, so as to provide rapid and economical shaping of the plastic concrete, together with suitable compacting and finishing, and a still further object of the present invention is to provide such a method wherein surfaces having relatively close tolerances are provided in cast in place or pre-cast concrete rail bed.

Other objects of the present invention include the provision of a rail for coacting with a concrete rail bed having a configuration providing high strength, and providing for the optimum transfer of forces from the railroad cars into the underlying concrete rail bed.

BRIEF DESCRIPTION OF THE DRAWING

FIG. 3 is a cross sectional view, showing a shaper in the form of a roller shaping the upper portions of the rail bed.

FIG. 4 is a view showing the grinding of portions of a rail bed.

FIG. 7 is a cross sectional view, with parts removed, showing tendon ducts and drains in a rail bed.

DESCRIPTION OF THE PREFERRED EMBODIMENT

Figure 1:
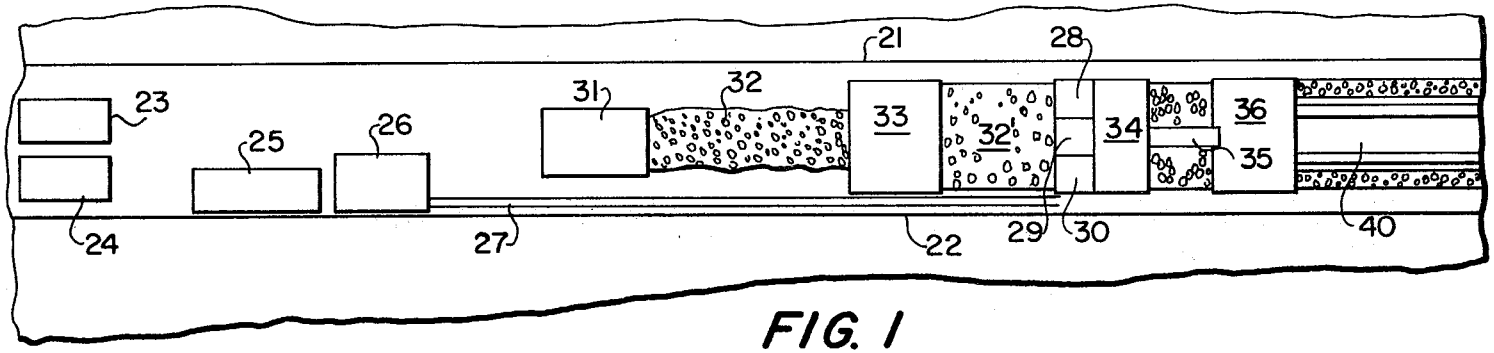
FIG. 1 is a schematic plan view showing a method of casting a concrete rail bed in place, in accordance with the present invention.

Referring now to the drawings, wherein like or corresponding reference numerals are used to designate like or corresponding parts throughout the several views, there is shown in FIG. 1 a cast in place paving operation in accordance with the present invention. The present invention is intended to provide for the construction of a railroad bed, particularly as a replacement structure on an existing right-of-way. For that reason, there are constraints in connection with the construction equipment which may be utilized, these being particularly the inability to use the areas which are laterally off of the right-of-way. Thus, construction equipment must be confined to the right-of-way, at least for large stretches thereof, and in addition all of the material must be delivered along the right-of-way ahead of the paving operation, and may not be delivered, for the most part, from the areas adjacent the right-of-way.

With the foregoing in mind, there is shown a right-of-way in FIG. 1, with paving proceeding from right to left. The sub-grade has edges 21 and 22. At the left there is shown a cement truck 23, a water truck 24 and an aggregate truck 25. An aggregate dump bin 26 is provided, having extending from it a conveyor belt 27 for delivering aggregate and cement. Beneath the conveyor belt, and not visible in FIG. 1, are water pipe lines. The conveyor belts 27 and the water pipe lines discharge into bins 28 and 29 for cement and aggregate, and into tank 30 for water.

A ballast hauling truck 31 is shown, having proceeded over the sub-grade from the left, and dumped ballast in a longitudinally extending pile, as indicated at 32. A machine 33 is provided for shaping and compacting the ballast, so as to leave to the rearwardly of it, to the right as shown in FIG. 1, a pile of ballast 32' which has been shaped and compacted.

A concrete mixer 34 is provided, for receiving the cement, aggregate and water from the bins 28 and 29 and tank 30, and for mixing the same into concrete, which is discharged onto a concrete conveyor 35, which delivers the plastic concrete to the paver 36. The paver 36 deposits the plastic concrete onto the ballast, and is shaped in a manner to be hereinbelow described, so as to provide a cast in place rail bed 40.

Figure 2:
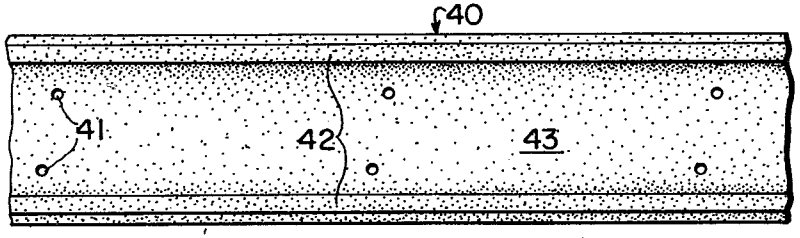
FIG. 2 is an enlarged plan view of a cast in place rail bed, in accordance with FIG. 1.

Referring to FIG. 2, there is shown an enlarged plan view of the cast in pace rail bed 40, including drainage holes 41 placed in staggered relationship relative to a transverse plane, and showing additionally a pair of spaced longitudinally extending pedestals 42, having a connecting portion 43 between the two pedestals 42. The drain holes 41 extend, as shown, through the connecting portion 43.

Referring now to FIG. 3, there is shown the cast in place concrete bed 40 during construction thereof, the bed 40 resting on the shaped and compacted ballast 32'. At the sides of the bed 40 are a pair of slip pans P, used for shaping the sides and portions of the bottom of the bed 40 while it is still in the plastic state. A cylinder 60 is provided having a cross section as shown for shaping the upper surface of the cast in place concrete. The cylinder 60 has a middle region 61 of relatively large diameter, and therefore of relatively large vertical depth. It also has a pair of end regions 62, which are of lesser depth, that is, of smaller diameter. An inclined shoulder 63 is provided, joining each of the end regions 62 to the middle region 61. Additionally, there may be provided disc-like portions 64, extending from each of the end regions 62.

The cylinder 60 is rolled over the poured in place or cast in place plastic concrete mass, to thereby shape the upper surfaces and portions thereof, effecting an extrusion of the plastic concrete. The cylinder thereby compacts and consolidates the concrete, and this compaction and consolidation is even greater than would be achieved by vibration alone. The rolling effect imparts a very dense, slick finish to the concrete, thereby providing a highly weather resistant finish. The cylinder 60 is provided with trunions 65 for support and engagement by a suitable machine, and it is preferably through these trunions 65 that the cylinder 60 is caused to vibrate while it is being rolled over the plastic concrete mass. This vibratory movement of the cylinder 60 is indicated by the arrow 66, and serves to provide additional compaction to the concrete.

The cylinder 60 provides a shape to the upper portion of the bed 40 as shown, including the provision of the laterally spaced pedestals 42 and the connecting portion 43. Where the disc-like portions 64 are used, the movement of the cylinder 60 also provides slots 44, which are used for receiving the stems of rails, as hereinbelow described.

Referring now to FIG. 4, there is shown a further step in the construction of the cast in place rail bed 40, which includes the step of grinding the slot 44 and the pedestal 42, as by the grinding wheel 67. This grinding wheel 67 is used to obtain suitable dimensional trueness for the slot 44 and, where necessary, for the top surface of the pedestal 42.

Referring again to FIG. 3, it will be noted that the pedestal 42 has a horizontal top surface 45, adjacent to which are the downwardly sloping shoulders **46*a* and 46*b*. Adjacent shoulder 46*a* is an outer side wall 47, generally vertical, having at its lower end an arcuate surface 48 which is joined to a bottom surface 49, which is horizontal. The connector 43 has a bottom surface 51 which is generally in the shape of an inverted V, having a flat angle and resting upon the ballast 32', thereby providing good seating and stability. The upper surface 52 of the connector 43 is generally horizontal, and is joined to the shoulders 46*b* of the pedestals 42 by arcuate portions 53**.

Figure 5:
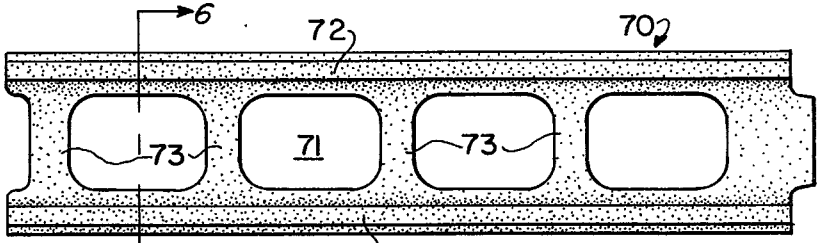
FIG. 5 is a plan view of a pre-cast concrete panel forming a part of a rail bed.

In FIG. 5, there is shown a pre-cast panel 70, having a pair of pedestals 72 in parallel, spaced apart relationship, the pedestals being joined by connectors 73 which extend transversely between the pedestals 72, and which are spaced from each other axially along the slab or panel 70. There is thus provided between the connectors 73 and the pedestals 72 cut-outs or openings generally designated 71 which permit drainage to pass through the slab 70 and into the ballast and sub-grade, and which also serve to reduce the weight and cost of the slab 70.

Figure 6:
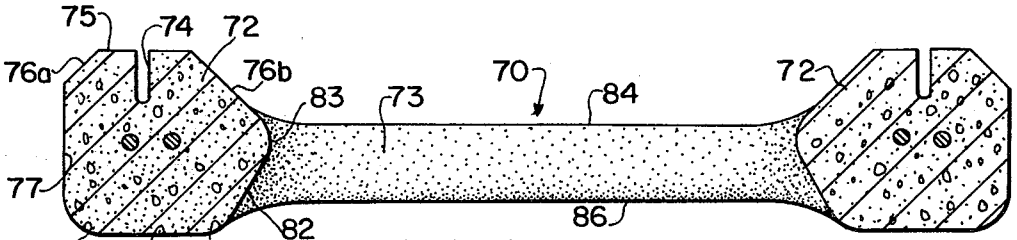
FIG. 6 is a cross sectional view taken on the line 6—6 of FIG. 5.

Referring to FIG. 6, the rail bed or slab 70 is shown, comprising the pair of longitudinally extending pedestals 72, located at the sides of the slab. Also shown is a connector 73, extending between and being integrally connected to the pedestals 72. Each of the pedestals 72 has a longitudinal and generally horizontal top surface 75, with a slot 74 extending into the pedestal 72 from the top surface thereof. The slot 74 terminates within the pedestal 72. At the sides of the top surface 75 there are an outer downwardly sloping shoulder **76*a* and an inner downwardly sloping shoulder 76*b*. An outer side wall 77, preferably vertical, provides the outer boundary of the pedestal 72, and is connected by an arcuate surface 78 to a flat, horizontal bottom support surface 79. The support surface 79 is connected by an arcuate surface 81 to an upwardly and inwardly sloping surface 82. This is joined by an arcuate portion 83 to the downwardly and outwardly sloping surface or shoulder 76*b*. In addition, the connector 73 has an upper surface 84 which lies below the top surfaces 75 of the pedestals 72, and has a bottom surface 86 which lies above the bottom surface 79 of the pedestals 72. Thus, the shoulders 76*a* and 76*b* provide for rapid run off of rain, the sloping surface 82 coacts with ballast to provide a stable positioning of the panel 70, and also coacts with the raised bottom surface 86 to provide additional stability for the entire panel or slab 70**.

Referring now to FIG. 7, there is shown schematically the position of the tendon ducts in the cast in place slab 40. Thus, there are shown longitudinally extending ducts 54 and 55 in each pedestal, located beneath the slot 44 which receives the rail, there also being shown the transverse duct 56. As will be understood, these ducts are provided for the placement of tendons, by which the slab 40 may be placed in compression. In addition, in FIG. 7 there is shown the drainage hole 41, and the shaped and compacted ballast 32'.

Figure 8:
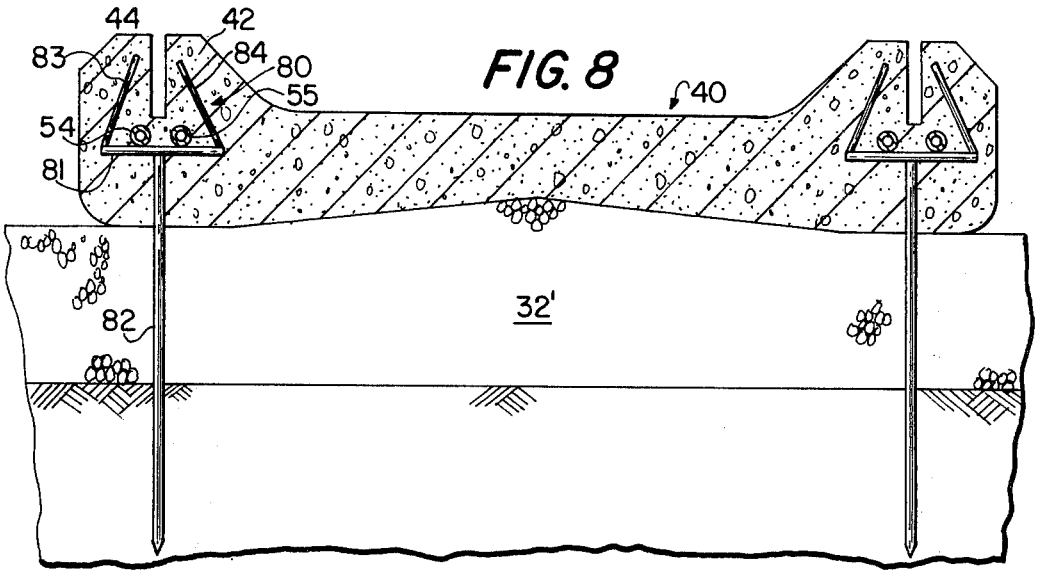
FIG. 8 is a cross sectional view of a rail bed, showing reinforcing elements and supports.

In FIG. 8, the cast in place rail bed 40 is seen, together with the ballast 32'. A reinforcing structure, generally designated 80, is provided in each of the pedestals 42, and includes a horizontal structural support, preferably in the form of a transverse bar, and designated 81. The bar 81 lies beneath the slot 44, being spaced from the inner end thereof. A support 82 for the bar 81 is provided, and comprises a vertically extending rod, which may be seen to extend through the bed 40, and into and even through the ballast 32', and into the sub-grade. As will be appreciated, the reinforcing structure including the rod 82 is placed in position prior to the placement of the concrete on the ballast 32'. The tendon ducts 54 and 55 are supported on the bar 81, and also supported on the bar 81 is a pair of longitudinally extending reinforcing members 83 and 84.

Figure 9:
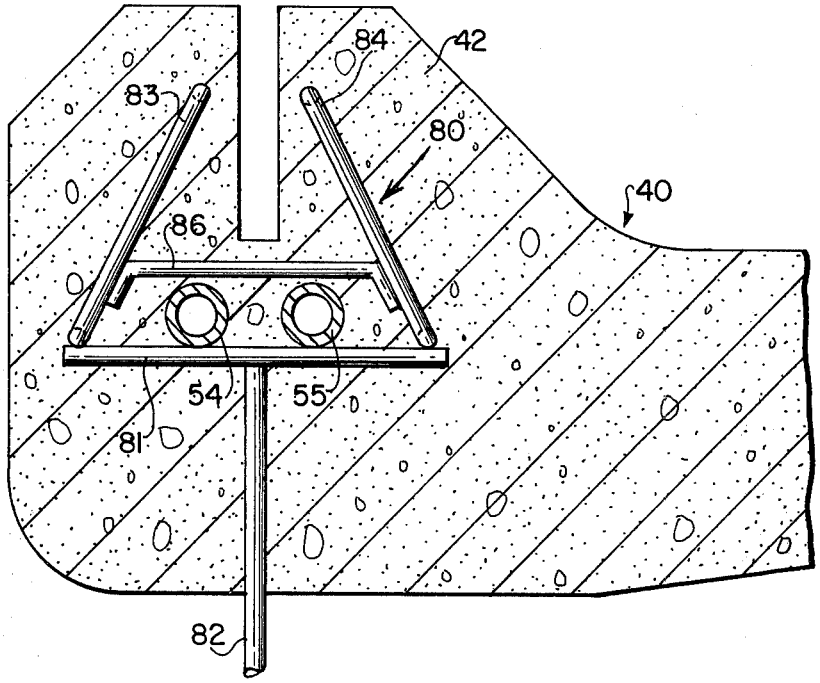
FIG. 9 is an enlarged view of a portion of the structure of FIG. 8, showing greater detail.

FIG. 9 shows the reinforcing structure 80 in greater detail. In addition to the bar 81, rod 82 and tendon ducts 54 and 55, the reinforcing members 83 and 84 may be seen to be made of rods or bars, being supported on the bar 81. The reinforcing members 83 and 84 are shown to be in inclined planes, one lying on either side of the slot 44 for receiving the rail. The reinforcing members 83 and 84 extend upwardly in the pedestal 42, and extend above the bottom of the slot 44. A transverse spacer 86 is provided which extends between and connects the reinforcing members 83 and 84, the spacer 86 being above and spaced from the horizontal bar 81, it being observed that the ducts 54 and 55 are in the space between the spacer 86 and and the bar 81.

Figure 10:
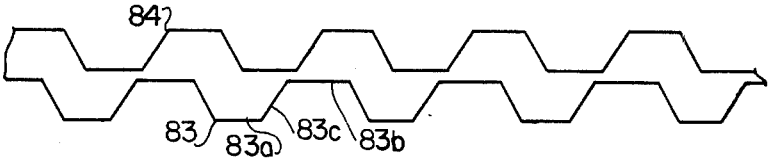
FIG. 10 is a schematic plan view showing longitudinal reinforcing members of FIG. 9.
Figure 11:
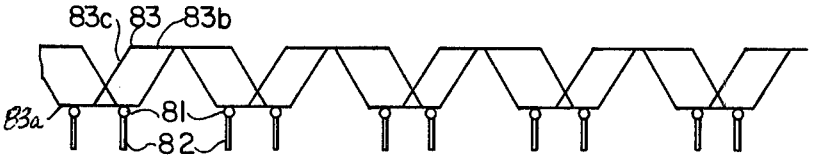
FIG. 11 is a schematic side elevation showing longitudinal reinforcement members of FIG. 9.

In FIG. 10 there is shown a schematic plan view of the reinforcing members 83 and 84. They are of generally undulating shape, the member 83 having a lower portion **83*a* which rests on the bar 81, an upper portion 83*b* which is that portion which is closest to the slot 44, and an inclined connecting portion 83c. FIG. 11 is an elevational representation of the reinforcing members 83 and 84, resting on a series of longitudinally spaced bars 81, supported by their rods 82**.

The shapes of the pedestals of the cast in place panel 40 and the pre-cast panel 70 will be seen to be generally similar, having major features in common, insofar as has been described in connection with the exterior shape of the pedestals, and the advantages obtained by the one are essentially the same as those obtained by the other. These include the aforementioned advantages of providing for rapid drain off of water, the absense of sharp corners, and the provision of a secure seating on the ballast. The tendon ducts shown in FIG. 7 are positioned prior to the pouring of the concrete which forms the bed 40. Where a pre-cast panel is provided, such ducts are positioned in the forms prior to the casting of the concrete therein to form the panels, such as the panel 70. Similarly, while reference has been had in FIGS. 8–11 to the reinforcing structure 80 placed in the cast in place bed or panel 40, it will be understood that essentially the same reinforcing structure will be placed within the pre-cast panel 70, except that there will be omitted the bar 82 which extends completely through the concrete forming the bed or panel 70. Otherwise, the reinforcing structure 80 will be understood to be present in the pedestal 72 of panel 70, placed in substantially the same position as illustrated in FIGS. 8–11.

Figure 12:
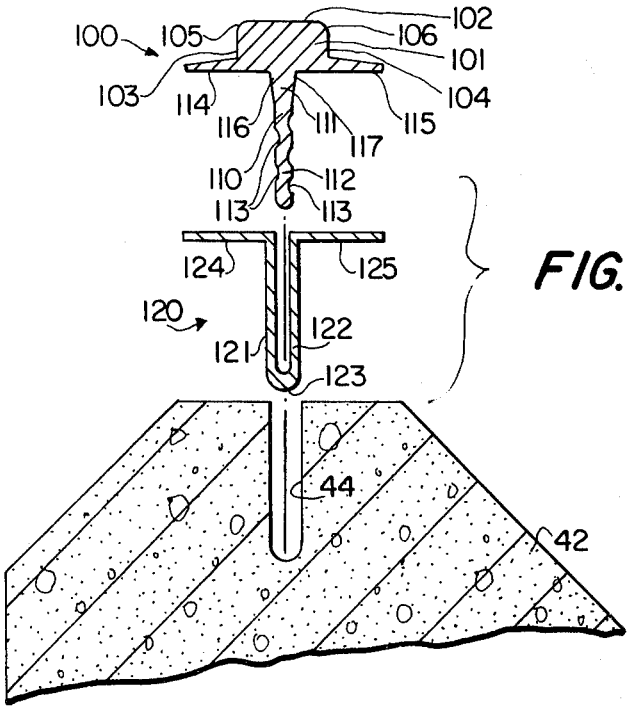
FIG. 12 is an exploded view showing a rail in accordance with the present invention, together with elastic bedding material and a portion of a concrete rail bed.

Referring now to FIG. 12, there is shown a rail 100 in accordance with the present invention, rail 100 being shown in cross section and being understood to be of indefinite length in accordance with standard practice. Rail 100 has a rail head 101 with a substantially horizontal upper wheel supporting surface 102 and a pair of substantially vertical side surfaces 103 and 104, joined to said upper surface 102 by arcuate portions 105 and 106. A stem 110 extends from the underside of the head 101, being the side remote from the upper surface 102. Stem 110 has a median plane which is substantially perpendicular to the upper surface 102 of rail head 101. Stem 110 has an upper portion 111, and a lower portion 112. The lower portion 112 is of uniform thickness, and has longitudinally extending grooves located on the sides thereof. Stem 110, which is laterally centered relative to the rail head 101, has the upper portion 111 thereof of uniformly increasing thickness, from the lower portion 112.

The grooves 113 are not confined to the lower portion 112, but the upper portion 111 may also be provided with one or more of the grooves 113, which are preferably lightly scribed.

A pair of flanges 114 and 115 are provided, being generally at the upper end of stem 110, and extending laterally outwardly on either side of the rail 100, the flanges 114 and 115 extending from the sides of the rail head 100, and being located remotely from the upper surface 102 of the rail head 101. The flanges 114 and 115 are outwardly tapered and have their under surfaces, that is, the surfaces remote from the upper surface 102 of rail head 101, inclined at an angle of slightly less than 90° to the median plane of the stem 110. Fillets 116 and 117 join the undersides of the flanges 114 and 115 to the side surfaces of the stem 110.

An elastomeric insert 120 is shown in FIG. 12, being of generally U-shape, and comprising a pair of side walls 121 and 122, joined by a bight 123 at the lower portions thereof. At their upper portions, the walls 121 and 122 are provided with outwardly extending flanges 124 and 125.

Also shown in FIG. 12 is the upper portion of pedestal 42. The reinforcing structure is not shown in FIG. 12, for purposes of simplicity, and as will be readily understood, while the pedestal has been designated 42, it may as readily be the pedestal 72. There is shown in the pedestal the slot 44 for receiving the stem 110 of rail 100, and the walls 121 and 122, and bight 123 of the insert 120.

Figure 13:
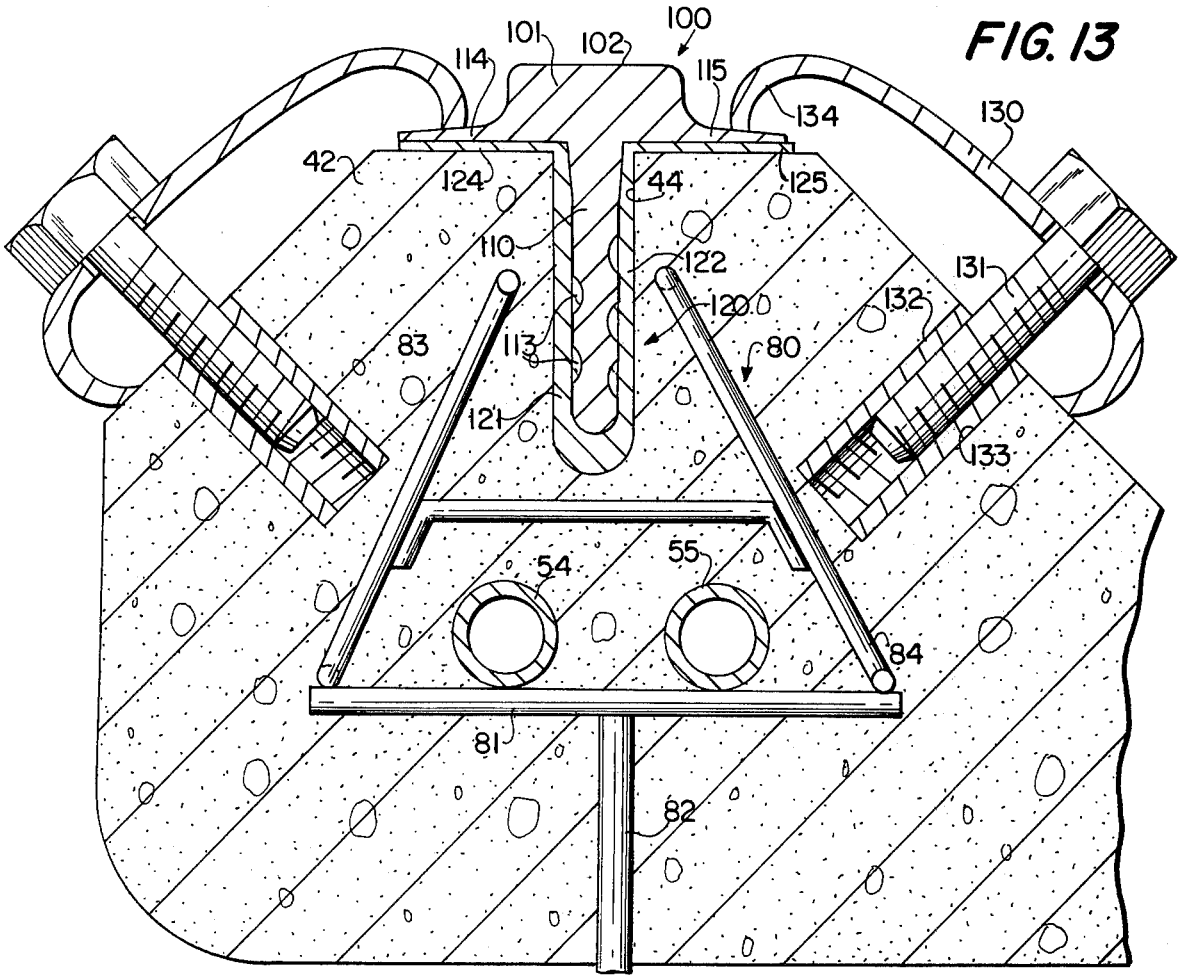
FIG. 13 is a cross sectional view showing a rail in accordance with the present invention in place, and hold-down clips.

Referring now to FIG. 13, there is shown the rail 100, placed in position in the pedestal 42 (or 72), FIG. 13 also showing the reinforcing structure 80. As shown, the stem 110 of the rail 100 is embedded in the elastomeric insert 120, which is retained in and substantially fills the slot 44, except for the portion of the slot taken up by the stem 110. The flanges 124 and 125 of the elastomeric insert 120 underlie the flanges 114 and 115 of the rail 100. The rail head 101 extends above the flanges, thereby presenting the upper surface 102 for engagement by the rim of the railroad wheel. The side surfaces 103 and 104 are presented, above the flanges 114 and 115, for engagement by the flanges of the railroad wheel, depending on whether the side surface 103 or 104 is on the gage side of the rail.

The downward forces will act on the rail head 101, and the flanges 114 and 115 will transmit those forces through the elastomeric flanges 124 and 125 into the pedestal 42, over a relatively wide area. This will avoid a high concentration of forces in the concrete pedestal. The stem 110, by extending into the slot 44, will serve to anchor the rail 100 against lateral movement, caused by forces applied to one or the other of the side surfaces 103, 104. In addition, due to the extension of the stem 110 in the slot 44, there will be great resistance to any overturning of the rail 100, and the great width of the rail head 101 will resist shear stresses. The grooves 113 will be filled with the elastomeric material of the insert 120, so as to enhance the bond between the rail 100 and the insert 120.

In order to resist uplift of the rail 100, there are provided holddown means, in the form of springs 130, secured to pedestal 42 by a bolt 131 threaded into a suitable metallic insert 132 positioned in a bore 133 in the pedestal 42. The hold-down spring 130 has an end 134 which engages on the upper surface of the outstanding flanges 114 or 115 of the rail 100, thereby anchoring the rail against upward movement due to uplift, after passage of a wheel of the train.

There has been provided a concrete slab rail bed providing good seating on underlying ballast, and in the case of a pre-cast panel forming a part of such a rail bed, relatively lighter weight. The bed as disclosed herein provides, in addition, good draining, with adequate strength, and is constructed so as to avoid breaking off portions of the concrete bed under stress.

Further, there has been disclosed herein concrete rail beds of suitable strength, stressed into a compressive state, and additionally having reinforcements which coact with the concrete and the stressing thereof to provide adequate strength against those forces imposed on the rail bed by trains moving thereover, such forces including downward loads, lateral loads, and uplift.

The herein described method provides for the rapid and economical placement of a concrete rail bed, having desired qualities of high strength, long life and relative ease of construction in confined areas. Further, the herein disclosed methods enable the provision of such concrete rail beds of suitable dimensional tolerance so as to accept rails and to thereby provide a suitably true surface for the rails.

In addition, there has been provided herein a rail for cooperation with the rail bed as herein disclosed, the rail providing for secure anchorage, superior transmission forces into the rail bed, and both cushioning and resistance to movement, either downwardly, laterally, or by uplift.

It will be obvious to those skilled in the art that various changes may be made without departing from the spirit of the invention, and therefore the invention is not limited to what is shown in the drawings and described in the specification but only as indicated by the appended claims.

I claim:

1. A concrete rail bed for supporting a pair of rails comprising:

a pair of longitudinally extending concrete rail-supporting pedestals joined by a concrete connecting portion, each said pedestal comprising a bottom support surface, an outer side wall, a longitudinal top surface, a slot extending into said pedestal through said top surface and terminating within said pedestal, said pedestals intermediate said connectors having an inwardly and downwardly sloping surface adjacent said top surface and an inwardly and upwardly sloping surface adjacent said bottom support surface, and a plurality of tendon ducts transverse and longitudinal of the rails and extending through said pedestals and said connecting portions for the placement of compression-inducing tendons and a plurality of compression-inducing tendons disposed within said ducts.

2. A concrete rail bed for supporting a pair of rails comprising:

a pair of longitudinally extending concrete rail-supporting pedestals joined by a concrete connecting portion, each said pedestal comprising a bottom support surface, an outer side wall, a longitudinal top surface, a slot extending into said pedestal through said top surface and terminating within said pedestal, said pedestals intermediate said connectors having an inwardly and downwardly sloping surface adjacent said top surface and an inwardly and upwardly sloping surface adjacent said bottom support surface, and longitudinally extending reinforcing means in each said pedestal, said reinforcing means comprising a plurality of horizontal members positioned below said slot and securing a pair of longitudinal tendon ducts and a pair of undulating longitudinally extending reinforcing members, one member on each side of, and inclined toward, said slot.

* * * * *